US009885001B2

(12) United States Patent
Niedermeyer

(10) Patent No.: US 9,885,001 B2
(45) Date of Patent: Feb. 6, 2018

(54) FUEL ADDITIVE COMPOSITION AND RELATED METHODS

(71) Applicant: ATTOSTAT, INC., Salt Lake City, UT (US)

(72) Inventor: William Harold Niedermeyer, West Jordan, UT (US)

(73) Assignee: ATTOSTAT, INC., Salt Lake City, UT (US)

( * ) Notice: Subject to any disclaimer, the term of this patent is extended or adjusted under 35 U.S.C. 154(b) by 0 days.

(21) Appl. No.: 14/861,562

(22) Filed: Sep. 22, 2015

(65) Prior Publication Data

US 2016/0083665 A1 Mar. 24, 2016

Related U.S. Application Data

(60) Provisional application No. 62/054,201, filed on Sep. 23, 2014.

(51) Int. Cl.
*C10L 1/12* (2006.01)

(52) U.S. Cl.
CPC ..... *C10L 1/1208* (2013.01); *C10L 2200/0204* (2013.01); *C10L 2200/024* (2013.01); *C10L 2200/0209* (2013.01); *C10L 2200/0222* (2013.01); *C10L 2200/0227* (2013.01); *C10L 2200/0231* (2013.01); *C10L 2200/0236* (2013.01); *C10L 2200/0245* (2013.01); *C10L 2250/06* (2013.01); *C10L 2290/24* (2013.01)

(58) Field of Classification Search
CPC ..... C10L 1/1208; C10L 2200/0204; C10L 2200/0245
USPC ..... 44/321, 354, 357
See application file for complete search history.

(56) References Cited

U.S. PATENT DOCUMENTS

| | | | |
|---|---|---|---|
| 4,515,740 | A | 5/1985 | Schuttenberg et al. |
| 5,227,608 | A | 7/1993 | Yoshida |
| 5,390,864 | A | 2/1995 | Alexander |
| 5,585,020 | A | 12/1996 | Becker et al. |
| 6,509,070 | B1 | 1/2003 | Voevodin et al. |
| 7,014,737 | B2 | 3/2006 | Harutyunyan et al. |
| 7,332,351 | B2 | 2/2008 | Tan et al. |

(Continued)

FOREIGN PATENT DOCUMENTS

| | | |
|---|---|---|
| CN | 102120619 | 7/2011 |
| CN | 103891558 | 7/2014 |

(Continued)

OTHER PUBLICATIONS

U.S. Appl. No. 13/175,708, filed Jul. 1, 2011, Final Office Action dated Mar. 28, 2016.

(Continued)

*Primary Examiner* — Ellen McAvoy
(74) *Attorney, Agent, or Firm* — Workman Nydegger

(57) ABSTRACT

Fuel additive compositions include a plurality of metal nanoparticles and a carrier that is dispersible in a hydrocarbon fuel. The metal nanoparticles can be spherical-shaped and/or coral-shaped metal nanoparticles. The carrier can be liquid, gel or solid and can be readily miscible or soluble in a hydrocarbon fuel such as gasoline, diesel, jet fuel, or fuel oil. The carrier can be a solid carrier configured to allow the hydrocarbon fuel to dissolve the solid carrier in order to release and disperse the metal nanoparticles within the hydrocarbon fuel.

20 Claims, 6 Drawing Sheets

(56) References Cited

U.S. PATENT DOCUMENTS

| | | | | |
|---|---|---|---|---|
| 7,371,457 | B2 | 5/2008 | Oldenburg et al. | |
| 7,374,730 | B2 | 5/2008 | Simard et al. | |
| 7,384,560 | B2 | 6/2008 | Martens et al. | |
| 7,509,993 | B1 | 3/2009 | Turng et al. | |
| 7,553,801 | B2 | 6/2009 | Alexander et al. | |
| 7,625,637 | B2 * | 12/2009 | Kim | B22F 1/0018 428/403 |
| 7,662,731 | B2 | 2/2010 | Itoh et al. | |
| 7,682,970 | B2 | 3/2010 | Grigoropoulos et al. | |
| 7,700,032 | B1 | 4/2010 | Lu et al. | |
| 7,884,160 | B2 | 2/2011 | Wang et al. | |
| 7,967,876 | B2 * | 6/2011 | Aradi | C10L 1/106 44/354 |
| 7,985,367 | B2 | 7/2011 | Hiromatsu et al. | |
| 8,490,583 | B1 * | 7/2013 | Gardenier | C10M 171/06 123/1 A |
| 8,685,293 | B1 | 4/2014 | Coppa et al. | |
| 8,883,865 | B2 * | 11/2014 | DiFrancesco | B01J 13/0034 423/263 |
| 2001/0031564 | A1 | 10/2001 | Suzuki et al. | |
| 2003/0086859 | A1 | 5/2003 | Kawakami et al. | |
| 2003/0102099 | A1 | 6/2003 | Yadav et al. | |
| 2004/0214001 | A1 | 10/2004 | Oldenburg et al. | |
| 2006/0142853 | A1 | 6/2006 | Wang et al. | |
| 2007/0287202 | A1 | 12/2007 | Maehashi et al. | |
| 2008/0035682 | A1 | 2/2008 | Coffey et al. | |
| 2008/0161631 | A1 | 7/2008 | Axtell et al. | |
| 2008/0263940 | A1 | 10/2008 | Parish et al. | |
| 2008/0292673 | A1 | 11/2008 | Crudden | |
| 2009/0000186 | A1 * | 1/2009 | Sanders | C10L 1/10 44/321 |
| 2009/0246530 | A1 | 10/2009 | Murakami et al. | |
| 2010/0040655 | A1 | 2/2010 | Ren et al. | |
| 2010/0050872 | A1 | 3/2010 | Lee | |
| 2010/0068299 | A1 | 3/2010 | van der Krieken et al. | |
| 2010/0072645 | A1 | 3/2010 | Hiromatsu et al. | |
| 2010/0180413 | A1 | 7/2010 | Jeong | |
| 2010/0183739 | A1 | 7/2010 | Newman | |
| 2010/0187091 | A1 | 7/2010 | Pierce et al. | |
| 2010/0196192 | A1 | 8/2010 | Liu et al. | |
| 2010/0212221 | A1 * | 8/2010 | Aradi | B82Y 30/00 44/500 |
| 2011/0039078 | A1 | 2/2011 | Fournet et al. | |
| 2011/0052460 | A1 | 3/2011 | Coffey et al. | |
| 2011/0155643 | A1 * | 6/2011 | Tov | B01D 3/009 208/119 |
| 2011/0193025 | A1 | 8/2011 | Ichikawa et al. | |
| 2011/0228890 | A1 | 9/2011 | Dean et al. | |
| 2011/0244056 | A1 | 10/2011 | Santra | |
| 2012/0088066 | A1 | 4/2012 | Aytug et al. | |
| 2012/0124899 | A1 * | 5/2012 | DiFrancesco | C10L 1/1241 44/457 |
| 2012/0136164 | A1 | 5/2012 | Ying et al. | |
| 2012/0138862 | A1 | 6/2012 | Hogan | |
| 2012/0164073 | A1 | 6/2012 | Xu et al. | |
| 2012/0174472 | A1 | 7/2012 | Mills | |
| 2012/0301531 | A1 | 11/2012 | Uhlmann et al. | |
| 2013/0001833 | A1 | 1/2013 | Niedermeyer | |
| 2013/0334104 | A1 | 12/2013 | Marsh | |
| 2013/0337998 | A1 * | 12/2013 | Irving | B01J 13/0017 502/167 |
| 2014/0274830 | A1 | 9/2014 | Pol et al. | |
| 2014/0288194 | A1 | 9/2014 | Niedermeyer | |

FOREIGN PATENT DOCUMENTS

| | | |
|---|---|---|
| CN | 104014811 | 9/2014 |
| KR | 20060021749 KR | 8/2006 |
| WO | WO2013141879 | 9/2013 |
| WO | WO2014066850 | 5/2014 |
| WO | WO2016007112 | 1/2016 |
| WO | WO2016007113 | 1/2016 |

OTHER PUBLICATIONS

U.S. Appl. No. 14/298,594, filed Jun. 6, 2014, Niedermeyer.
U.S. Appl. No. 14/861,243, filed Sep. 22, 2015, Niedermeyer.
U.S. Appl. No. 14/861,318, filed Sep. 22, 2015, Niedermeyer.
U.S. Appl. No. 14/861,375, filed Sep. 22, 2015, Niedermeyer.
U.S. Appl. No. 14/861,442, filed Sep. 22, 2015, Niedermeyer.
U.S. Appl. No. 14/861,500, filed Sep. 22, 2015, Niedermeyer.
Chien et al., "Synthesis of nanoparticles: sunlight formation of gold nanodecahedra for ultra-sensitive lead-ion detection", Green Chem., vol. 13, pp. 1162-1166, May 2011.
International Search Report for PCT App. No. PCT/US2015/051642 dated Dec. 14, 2015.
International Search Report for PCT App. No. PCT/US2015/051638 dated Dec. 17, 2015.
International Search Report for PCT App. No. PCT/US2015/051640 dated Dec. 17, 2015.
International Search Report for PCT App. No. PCT/US2015/051643 dated Dec. 17, 2015.
International Search Report for PCT App. No. PCT/US2015/051649 dated Dec. 17, 2015.
International Search Report for PCT App. No. PCT/US2015/051646 dated Dec. 18, 2015.
Liu et al., "A novel coral-like porous SnO2 hollow architecture: biomimetic swallowing growth mechanism and enhanced photovoltaic property for dye-sensitized solar cell application", Chem. Commun., vol. 46, pp. 472-474, 2010.
Office Action, filed Jul. 1, 2011, Office Action dated May 30, 2014.
Final Office Action, filed Jul. 1, 2011, Final Office Action dated Nov. 13, 2014.
Office Action, filed Jul. 1, 2011, Office Action dated Jul. 6, 2015.
Badawy et al., "Surface Charge-Dependent Toxicity of Silver Nanoparticles", Environ. Sci. Technol. 2011, 45, 283-287.
U.S. Appl. No. 14/861,243, filed Sep. 22, 2015, Office Action dated Mar. 9, 2016.
U.S. Appl. No. 15/088,863, filed Apr. 1, 2016, Tarbet et al.
U.S. Appl. No. 15/098,071, filed Apr. 13, 2016, Tarrbet et al.
International Search Report for PCT App. No. PCT/US2012/044907 dated Jan. 31, 2013.
U.S. Appl. No. 14/861,318, filed Sep. 22, 2015, Office Action dated Apr. 25, 2016.
U.S. Appl. No. 14/861,318, filed Sep. 22, 2015, Notice of Allowance dated May 20, 2016.
U.S. Appl. No. 14/861,318, filed Sep. 22, 2015, Corrected Notice of Allowance dated Jun. 15, 2016.
U.S. Appl. No. 14/861,243, filed Sep. 22, 2015, Final Office Action dated Jul. 26, 2016.
U.S. Appl. No. 15/415,562, filed Jan. 25, 2015, Niedermeyer.
Jacobson, "These six diseases should worry you more than Ebola", Inside Energy Oct. 2014; [online] retrieved on Jan. 29, 2017 from http://www.pbs.org/newshour/updates/six-diseases-actually-worry/; 10 pages.
Pal et al., "Does the Antibacterial Activity of Silver Nanoparticles Depend on the Shape of the Nanoparticle?", Applied and Environmental Microbiology, 2007; 73(6): 1712-1720.
Prabhu et al., "Silver nanoparticles: mechanism of antimicrobial action, synthesis, medical applications, and toxicity effects", International Nano Letters, 2012, 2:32, pp. 1-10.
Rawashdeh et al., "Antibacterial Mechanisms of Metallic Nanoparticles: A Review", Dynamic Biochemistry, Process Biotechnology and Molecular Biology 2009 pp. 12-20.
Sahu et al., "Flower Shaped Silver Nanostructures: An Efficient Bacteria Exterminator", A Search for Antibacterial Agents; Chapter 2; [online] retrieved from: http://www.intechopen.com/books/a-search-for-antibacterial-agents; 2007; 73(6): 1712-1720.
U.S. Appl. No. 14/861,243, filed Sep. 22, 2015, Final Office Action dated Jan. 27, 2017.
U.S. Appl. No. 15/088,863, filed Apr. 1, 2016, Office Action dated Feb. 3, 2017.
U.S. Appl. No. 13/175,708, filed Jul. 1, 2011, Office Action dated Feb. 10, 2017.
U.S. Appl. No. 14/861,442, filed Sep. 22, 2015, Final Office Action dated Feb. 22, 2017.

(56) References Cited

OTHER PUBLICATIONS

Santos et al., "Enhancemetn of antibiotic effect via gold:silver-alloy nanoparticles", J. Nanopart Res (2012) 14:859, pp. 1-8.
U.S. Appl. No. 14/861,442, filed Sep. 22, 2015, Office Action dated Sep. 29, 2016.
U.S. Appl. No. 14/864,243, filed Sep. 22, 2015, Office Action dated Nov. 2, 2016.
Barcikowski et al., "Generation of nanoparticle colloids by picosecond and femtosecond laser ablations in liquid flow", Appl. Phys. Lett. 91, 083113 (2007).
Jana et al., "Seeding Growth for Size Control of 5-40 nm Diameter Gold Nanoparticles", Langmuir 2001, 17, 6782-6786.
Mafuné et al., "Formation of Stable Platinum Nanoparticles by Laser Ablation in Water", J. Phys. Chem. B 2003, 107, 4218-4223.
Phuoc et al, "Synthesis of Ag-deoionized water nanofluids using multi-beam laser ablation in fluids", Optics and Lasers in Engineering 45 (2007) 1099-1106.
Riabinina et al., "Influence of pressure on the Pt nanoparticle growth modes during pulsed laser ablation", Journal of Applied Physics 108, 034322 (2010, published online Aug. 12, 2010).
Sylvestre et al., "Surface Chemistry of Gold Nanoparticles Produced by Laser Ablation in Aqueous Media", J Phys. Chem. B 2004, 108, 16864-16869.
Sweeney et al., "Rapid Purification and Size Separation of Gold Nanoparticles via Diafiltration", J. Am. Chem. Soc. 2006, 128, 3190-3197 (Published on web Feb. 18, 2006).
U.S. Appl. No. 14/298,594, filed Jun. 6, 2014, Office Action dated Mar. 21, 2017.
Mycozil, "The Benefits of Colloidal Silver for Toenail Fungus", http://www.nailfungustoenail.com/benefitsofcol-loidalsilverfortoenailfungus.html.
U.S. Appl. No. 15/415,562, filed Jan. 25, 2017, Office Action dated May 23, 2017.
U.S. Appl. No. 15/088,863, filed Apr. 1, 2016, Office Action dated Jul. 11, 2017.

* cited by examiner

FUEL ADDITIVE COMPOSITION AND RELATED METHODS

CROSS-REFERENCE TO RELATED APPLICATIONS

This application claims the benefit of U.S. Provisional Patent Application No. 62/054,201, filed Sep. 23, 2014, the disclosure of which is incorporated herein in its entirety.

BACKGROUND

1. Field of the Invention

Disclosed herein are fuel additive compositions and methods for making and using such compositions.

2. Relevant Technology

Fuel additives are commonly added to hydrocarbon fuels, such as gasoline and diesel, to provide a wide variety of known benefits, such to boost octane and reduce engine knock, reduce formation and buildup of deposits, clean fuel injectors, improve fuel combustion efficiency, maintain flow of diesel during cold weather, and disperse water.

Fuel additives typically include a fuel compatible solvent, such as petroleum distillates, alcohol, toluene, xylene, or trimethyl benzene, and may include one or more other active agents in relatively small quantities, such as antioxidants.

Recently, fuel additives have been proposed which contain nanoparticles made from boron (B), boron/rare earth oxides, boron/iron composites (B/Fe), cerium oxide ($CeO_2$), doped cerium oxide, aluminum (Al), magnesium-aluminum, cobalt oxide ($Co_3O_4$), or iron oxides. A common feature of such nanoparticles is that they are made from relatively low cost metals that are easily oxidized into ionic form. Notwithstanding the foregoing, fuel additives containing nanoparticles have yet to attain market acceptance and have been viewed with suspicion by environmentalists and the EPA in view of the generally highly reactive nature of nanoparticles, particularly metal compounds containing metal ions or metals that can easily oxidize during combustion.

U.S. Pat. No. 6,152,972 discloses gasoline additives for catalytic control of emissions from combustion engines. Such additives are in the form of a solid briquette deposited in a gas or a filter placed in a gas line and contain metal compounds, including noble metal compounds such as a combination of $X_2$ $PtCl_6$, $RhCl_3$ and $XReO_4$, where X=K, Rh or Cs, which are formulated to slowly dissolve into gasoline. Following combustion, such compounds are carried by exhaust gases through the exhaust system and deposited on exhaust system surfaces to provide catalyst sites for conversion of toxic emissions.

Noticeably absent in the art is any known or proposed way to manufacture fuel additives containing nanoparticles made from nonionic, ground state metals or metal mixtures or alloys, such as noble metals, transition metals, or rare earth metals.

SUMMARY

Disclosed herein are fuel additive compositions and related methods of manufacturing and using fuel additive compositions. The fuel additive compositions can be used as an additive for any hydrocarbon fuel, including, but not limited to, gasoline, diesel, jet fuel, propane, butane, white gas, coal, synthetically derived fuels, fuel oil, and bunker oil.

According to some embodiments the fuel additive composition may comprise: (1) a carrier that is readily miscible in a hydrocarbon fuel; and (2) a plurality of non-ionic metal nanoparticles selected from the group consisting of solid spherical-shaped metal nanoparticles and coral-shaped metal nanoparticles in which each coral-shaped metal nanoparticle has a non-uniform cross section and a globular structure formed by multiple, non-linear strands joined together without right angles.

According to some embodiments, the fuel additive composition may comprise: (1) a hydrocarbon soluble carrier; and (2) a plurality of spherical-shaped and/or coral-shaped metal nanoparticles comprising at least one nonionic, ground state metal selected from the group consisting of gold, platinum, silver, palladium, rhodium, osmium, ruthenium, rhodium, rhenium, molybdenum, copper, iron, nickel, tin, beryllium, cobalt, antimony, chromium, manganese, zirconium, tin, zinc, tungsten, titanium, vanadium, lanthanum, cerium, heterogeneous mixtures thereof, and alloys thereof.

According to some embodiments, a method of treating a hydrocarbon fuel comprising adding a fuel additive composition as disclosed herein to the hydrocarbon fuel, preferably an amount of fuel additive composition to yield a treated hydrocarbon fuel containing from about 10, 30, or 50 parts per billion ("ppb") to about 10 ppm of metal nanoparticles by weight, or about 100 ppb to about 5 ppm, or about 200 ppb to about 1 ppm, or about 300 ppb to about 800 ppb of metal nanoparticles by weight. The hydrocarbon fuel can be treated while inside a fuel tank of a vehicle or motor. Alternatively, the hydrocarbon fuel can be treated while contained within a large storage or dispensing vessel, an example of which is a storage tank at a fuel filling facility.

According to some embodiments, a method of manufacturing a fuel additive composition comprises combining (1) a plurality of nonionic metal nanoparticles selected from the group consisting of solid spherical-shaped metal nanoparticles and coral-shaped metal nanoparticles in which each coral-shaped metal nanoparticle has a non-uniform cross section and a globular structure formed by multiple, non-linear strands joined together without right angles and (2) a carrier that is soluble or readily miscible in a hydrocarbon fuel.

The fuel additive compositions disclosed herein can provide the following benefits, including but not limited to: improved fuel efficiency, reduced emissions (e.g., unburned hydrocarbons, soot, and/or carbon monoxide), corrosion resistance, engine knock reduction, improved valve performance, and lower engine temperatures.

These and other advantages and features of the invention will be set forth in part in the description which follows, and in part will become apparent to those skilled in the art upon examination of the following or may be learned by practice of the invention.

DETAILED DESCRIPTION OF THE PREFERRED EMBODIMENTS

Disclosed herein are fuel additive compositions that provide metal nanoparticles that are readily dispersible into a hydrocarbon fuel. In some embodiments, the metal nanoparticles are dispersed within or contained on or within in a carrier that is readily miscible in a hydrocarbon fuel. The carrier can be a liquid, gel or solid. The fuel additive compositions can be formulated for use as an additive for any hydrocarbon fuel, including, but not limited to, gasoline, diesel, jet fuel, propane, butane, white gas, coal, synthetically derived fuels, fuel oil, and bunker oil.

Nanoparticle Configurations

In some embodiments, the metal nanoparticles may comprise or consist essentially of nonionic, ground state metal nanoparticles. Examples include spherical-shaped metal nanoparticles, coral-shaped metal nanoparticles, or a blend of spherical-shaped metal nanoparticles and coral-shaped metal nanoparticles.

In some embodiments, nonionic metal nanoparticles useful for making fuel additive compositions comprise spherical nanoparticles, preferably spherical-shaped metal nanoparticles having a solid core. The term "spherical-shaped metal nanoparticles" refers to nanoparticles that are made from one or more metals, preferably nonionic, ground state metals, having only internal bond angles and no external edges or bond angles. In this way, the spherical nanoparticles are highly resistant to ionization, highly stable, and highly resistance to agglomeration. Such nanoparticles can exhibit a high ξ-potential, which permits the spherical nanoparticles to remain dispersed within a polar solvent without a surfactant, which is a surprising and expected result.

In some embodiments, spherical-shaped metal nanoparticles can have a diameter of about 40 nm or less, about 35 nm or less, about 30 nm or less, about 25 nm or less, about 20 nm or less, about 15 nm or less, about 10 nm or less, about 7.5 nm or less, or about 5 nm or less. In some embodiments, spherical-shaped nanoparticles can have a particle size distribution such that at least 99% of the nanoparticles have a diameter within 30% of the mean diameter of the nanoparticles, or within 20% of the mean diameter, or within 10% of the mean diameter. In some embodiments, spherical-shaped nanoparticles can have a mean particle size and at least 99% of the nanoparticles have a particle size that is within ±3 nm of the mean diameter, ±2 nm of the mean diameter, or ±1 nm of the mean diameter. In some embodiments, spherical-shaped nanoparticles can have a ξ-potential of at least 10 mV, preferably at least about 15 mV, more preferably at least about 20 mV, even more preferably at least about 25 mV, and most preferably at least about 30 mV.

Figure 1:
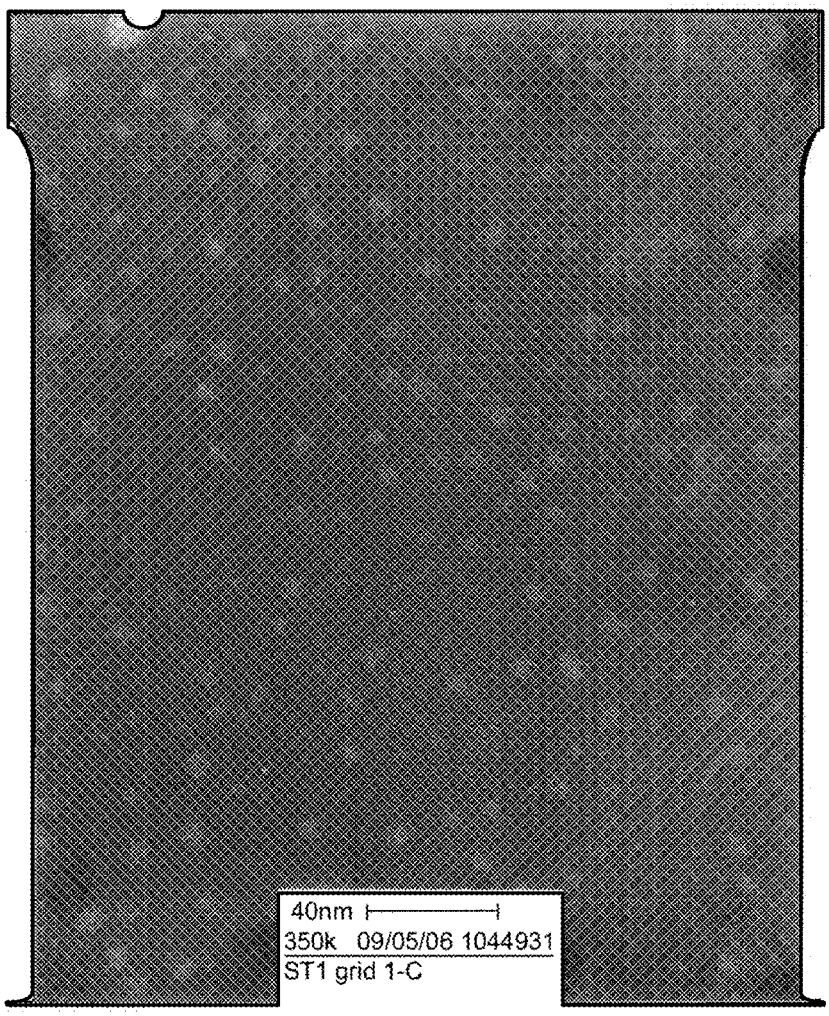
FIG. 1 is a transmission electron microscope image (TEM) of exemplary spherical-shaped metal nanoparticles having substantially uniform size and narrow particle size distribution for use in making fuel additive compositions.
Figure 2A:
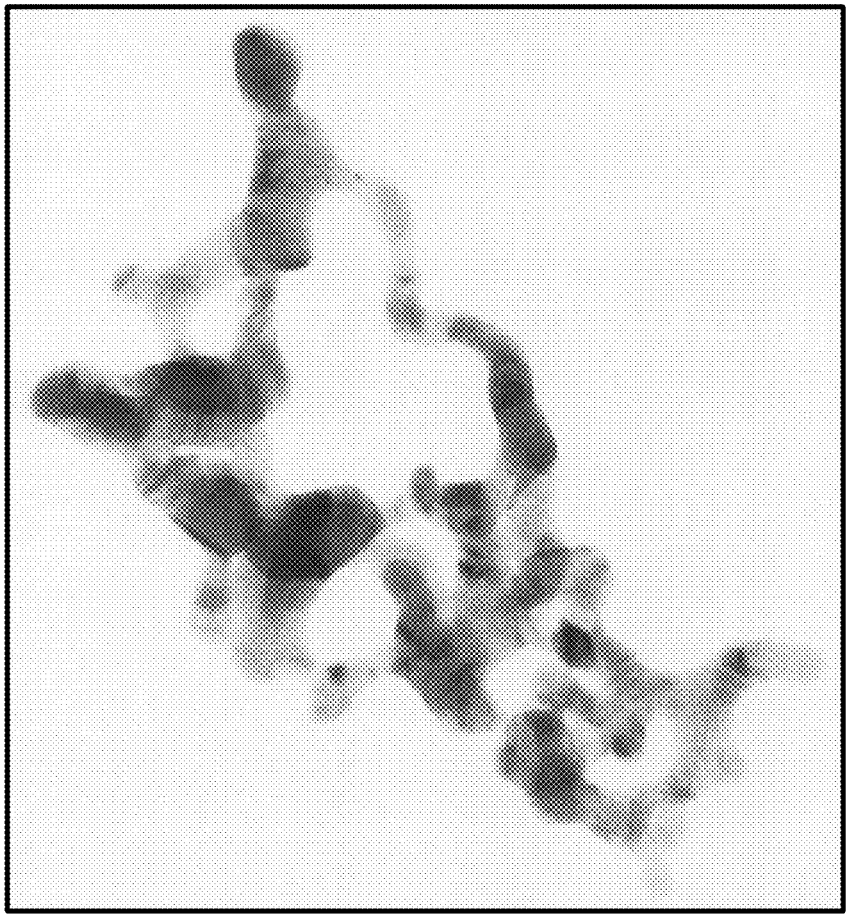
FIGS. 2A-2E are transmission electron microscope images (TEMs) of exemplary coral-shaped metal nanoparticles for use in making fuel additive compositions.
Figure 2B:
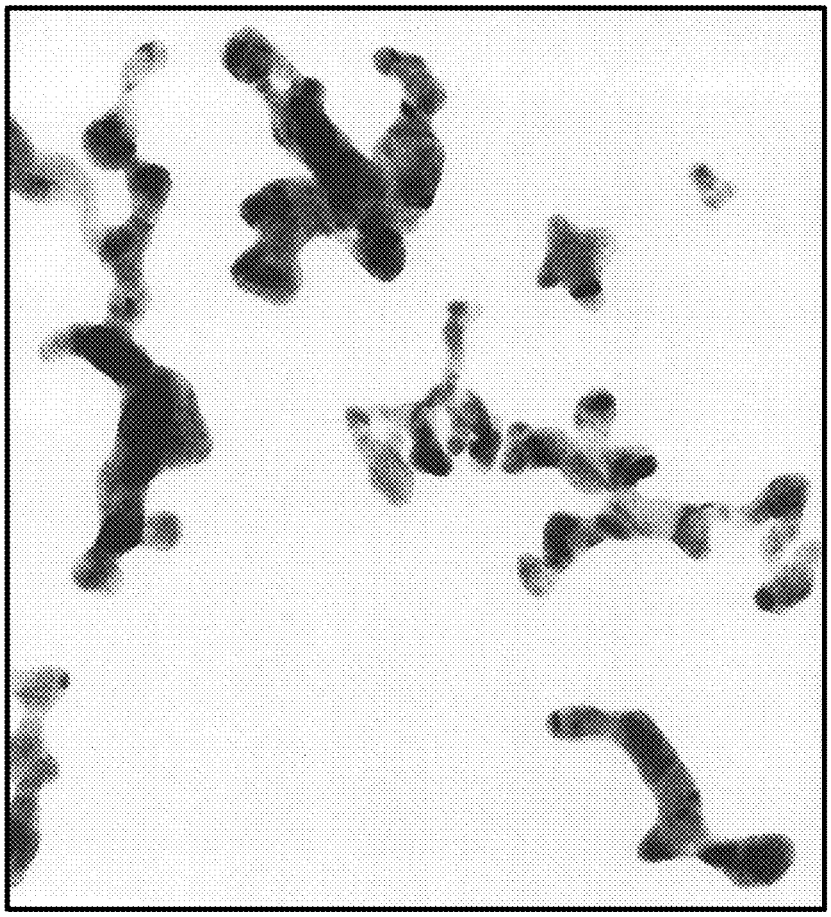
Figure 2C:
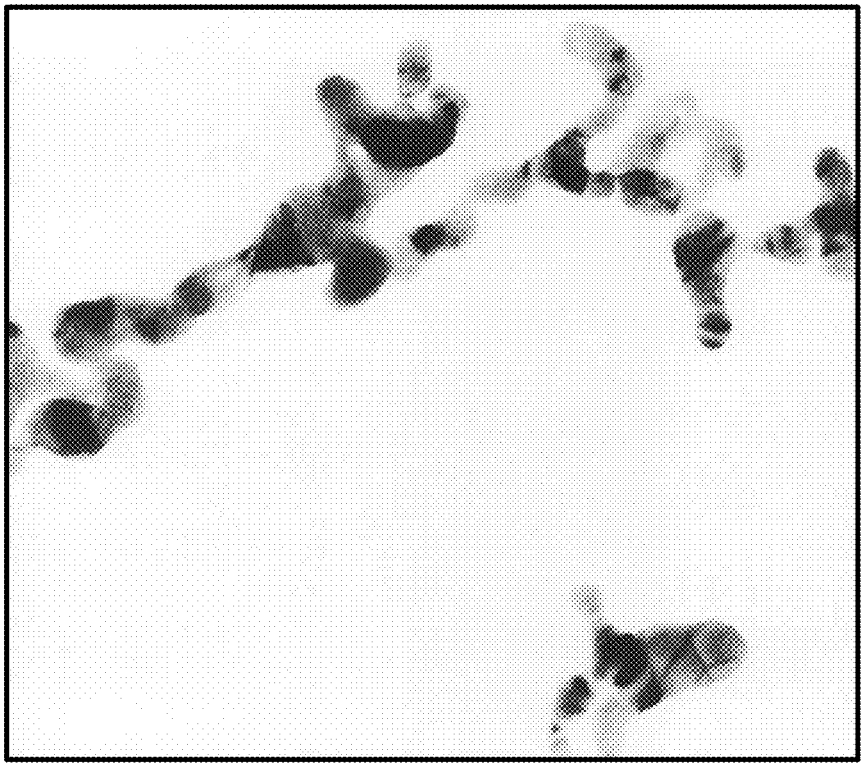
Figure 2D:
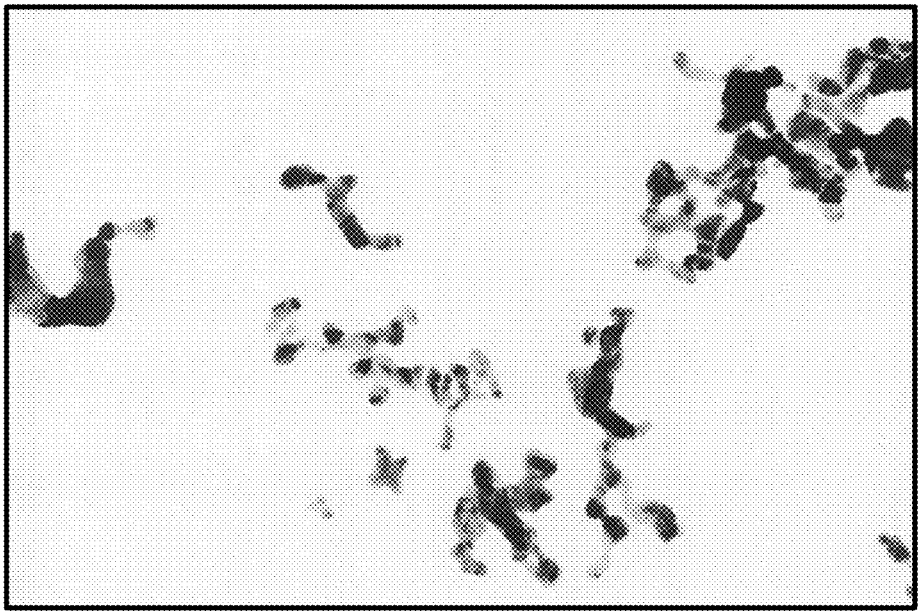
Figure 2E:
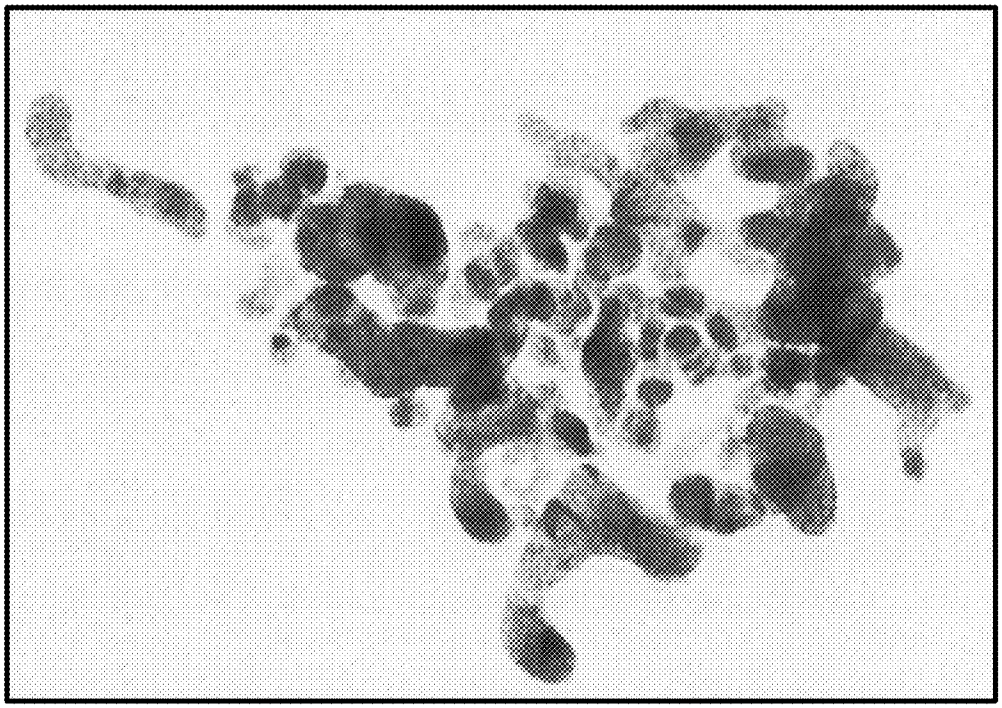

Examples of methods and systems for manufacturing spherical-shaped nanoparticles are disclosed in U.S. Pat. Pub. No. 2013/0001833 to William Niedermeyer (the "Niedermeyer Publication"), incorporated herein by reference. FIG. 1 is a transmission electron microscope image (TEM) of exemplary spherical-shaped nanoparticles made using the methods and systems of the Niedermeyer Publication. The illustrated nanoparticles are spherical-shaped silver (Ag) nanoparticles of substantially uniform size, with a mean diameter of about 10 nm and a narrow particle size distribution. In some embodiments, spherical-shaped nanoparticles can have a solid core rather than being hollow, as is the case with conventional metal nanoparticles, which are usually formed on the surfaces of non-metallic seed nanoparticles (e.g., silica), which are thereafter removed to yield hollow nanospheres.

In some embodiments, nonionic metal nanoparticles useful for making fuel additive compositions may comprise coral-shaped nanoparticles. The term "coral-shaped metal nanoparticles" refers to nanoparticles that are made from one or more metals, preferably nonionic, ground state metals having a non-uniform cross section and a globular structure formed by multiple, non-linear strands joined together without right angles. Similar to spherical-shaped nanoparticles, coral-shaped nanoparticles may have only internal bond angles and no external edges or bond angles. In this way, coral-shaped nanoparticles can be highly resistant to ionization, highly stable, and highly resistance to agglomeration. Such coral-shaped nanoparticles can exhibit a high ξ-potential, which permits the coral-shaped nanoparticles to remain dispersed within a polar solvent without a surfactant, which is a surprising and expected result.

In some embodiments, coral-shaped nanoparticles can have lengths ranging from about 15 nm to about 100 nm, or about 25 nm to about 95 nm, or about 40 nm to about 90 nm, or about 60 nm to about 85 nm, or about 70 nm to about 80 nm. In some embodiments, coral-shaped nanoparticles can have a particle size distribution such that at least 99% of the nanoparticles have a length within 30% of the mean length, or within 20% of the mean length, or within 10% of the mean length. Testing has shown that the benefit of coral-shaped particles is less a function of the specific length of the coral-shaped nanoparticles, leading to the conclusion that the catalytic effects are a result of small protrusions on the coral-shaped particles that mimic the effect of the small (e.g., 4 nm) spherical particles. In some embodiments, coral-shaped nanoparticles can have a ξ-potential of at least 10 mV, preferably at least about 15 mV, more preferably at least about 20 mV, even more preferably at least about 25 mV, and most preferably at least about 30 mV.

Examples of methods and systems for manufacturing coral-shaped nanoparticles are disclosed in U.S. Provisional Application No. 62/054,126, filed Sep. 23, 2014, in the name of William Niedermeyer (the "Niedermeyer Application"), which is incorporated by reference. FIGS. 2A-2E are transmission electron microscope images (TEMs) of exemplary coral-shaped metal nanoparticles made using the methods and systems of the Niedermeyer Application. The illustrated nanoparticles are coral-shaped gold nanoparticles.

Coral-shaped metal nanoparticles can be used instead of or in conjunction with spherical-shaped metal nanoparticles. In general, spherical-shaped metal nanoparticles can be smaller than coral-shaped metal nanoparticles and in this way can provide very high surface area for catalyzing desired reactions or providing other desired benefits. On the other hand, the generally larger coral-shaped nanoparticles can exhibit higher surface area per unit mass compared to spherical-shaped nanoparticles because coral-shaped nanoparticles have internal spaces and surfaces rather than a solid core and only an external surface. In some cases, providing nanoparticle compositions containing both spherical-shaped and coral-shaped nanoparticles can provide synergistic results. For example, coral-shaped nanoparticles can help carry and/or potentiate the activity of spherical-shaped nanoparticles in addition to providing their own unique benefits.

In some embodiments, the fuel treatment compositions may include both spherical-shaped and coral-shaped nanoparticles. In some embodiments, the mass ratio of spherical-shaped nanoparticles to coral-shaped nanoparticles in the fuel treatment composition can be in a range of about 1:1 to about 50:1, or about 2.5:1 to about 25:1, or about 5:1 to about 20:1, or about 7.5:1 to about 15:1, or about 9:1 to about 11:1, or about 10:1. The particle number ratio of spherical-shaped nanoparticles to coral-shaped nanoparticles in the fuel treatment composition can be in a range of about 10:1 to about 500:1, or about 25:1 to about 250:1, or about 50:1 to about 200:1, or about 75:1 to about 150:1, or about 90:1 to about 110:1, or about 100:1, The non-ionic metal nanoparticles, including spherical-shaped and coral-shaped nanoparticles, may comprise any desired metal, mixture of metals, or metal alloy, including at least one of silver, gold, platinum, palladium, rhodium, osmium, ruthenium, rhodium, rhenium, molybdenum, copper, iron, nickel, tin, beryllium, cobalt, antimony, chromium, manganese, zirconium, tin, zinc, tungsten, titanium, vanadium, lanthanum, cerium, heterogeneous mixtures thereof, or alloys thereof.

Carriers

The fuel additive composition also includes a carrier for delivering the metal nanoparticles to a hydrocarbon fuel into which they will be mixed. The carrier can be a liquid, gel, or solid. Some carriers may be more suitable than others depending on the hydrocarbon fuel into which the fuel additive composition is to be added. For example, the solubility characteristics of the carrier can be selected to maximize or otherwise provide a desired solubility with the hydrocarbon fuel. In many cases it may be desirable for the carrier material(s) to be readily miscible or soluble within the hydrocarbon fuel being treated. Some carriers can be soluble in virtually any hydrocarbon fuel, while others can be more soluble in some fuels and less soluble in others. In the case of solid fuels, such as coal, charcoal, or biomass, it may not be necessary or desirable for the carrier to be soluble in the fuel. If applied to a solid fuel, for example, it may or may not be desirable for the carrier to evaporate.

Examples of carrier liquids that can be used to formulate fuel oil compositions as disclosed herein include, but are not limited to, vegetable oils, nut oils, triglycerides, petroleum distillates, alcohols, ketones, esters, ethers, organic solvents, methanol, ethanol, isopropyl alcohol, other lower alcohols, glycols, and surfactants.

Gels known in the art can be used as carriers, such as gels containing one or more of the foregoing liquid components together with known gelling agents. As compared to a liquid additive, gel additives can be more easily enclosed or encapsulated by a solid enclosure to form a pre-measured packet that can be used to treat a specific quantity of fuel. In addition, while gel additives can be formulated to dissolve into many different types of hydrocarbon fuels, they may be desirable in the case of more viscous fuels, such as some types of fuel oil and bunker oil, where a mixing apparatus is used to mix the viscous fuel and fuel additive together (e.g., because it is sometimes easier to mix two materials having similar viscosities compared to materials having greatly differing viscosities).

Solid carriers can be used for different reasons, such as to enclose nanoparticles as a pre-measured tablet to treat a specific quantity of fuel. A solid carrier can also be used to enclose a fuel additive composition containing nanoparticles and a liquid or gel carrier. In many cases, it will be advantageous for the solid carrier to be readily dissolvable in the hydrocarbon fuel. Examples of solid carriers include, but are not limited to, polymers, rubbers, elastomers, foams, and gums. Depending on the solvent characteristics of the fuel to be treated and the desired level of solubility of the carrier, one of skill in the art can select an appropriate solid carrier material.

In some embodiment, a fuel additive composition can be formulated so that the metal nanoparticles are included in a concentration so that a measured quantity of the fuel additive composition, when mixed with a given quantity of hydrocarbon fuel, will yield a treated hydrocarbon fuel containing a predetermined concentration or quantity of metal nanoparticles. By way of example, the metal nanoparticles can be included in a concentration so that a measured or predetermined quantity of the fuel additive composition, when mixed with the given quantity of hydrocarbon fuel, will yield a treated fuel containing from about 10, 30, or 50 parts per billion ("ppb") to about 10 ppm of metal nanoparticles by weight, or about 100 ppb to about 5 ppm, or about 200 ppb to about 1 ppm, or about 300 ppb to about 800 ppb of metal nanoparticles by weight.

The fuel additive composition itself will have a higher concentration of nanoparticles that become diluted when mixed with the fuel. Depending on the type of fuel being treated, the nature of the nanoparticles being added, and the type of carrier being used, the fuel additive composition may contain about 10 ppm to about 100 ppm of metal nanoparticles by weight, or about 20 ppm to about 80 ppm, or about 30 ppm to about 60 ppm of metal nanoparticles by weight.

In some embodiments, the fuel additive composition can be provided in a pre-dosed quantity formulated to treat from about 10 gallons (38 liters) to about 30 gallons (114 liters) of hydrocarbon fuel, or 15 gallons (57 liters) to about 25 gallons (95 liters) of hydrocarbon fuel.

In some embodiments, the fuel additive composition can also include one or more optional components to provide desired properties, including, but not limited to detergents, octane boosters, corrosion inhibitors, anti-knock agents, or valve cleaners.

In some embodiments, the carrier may also function as, or may include, a stabilizing agent. For example, in some embodiments it may be desirable to have different specifically sized nanoparticles within the same solution to take advantage of each of the different properties and effects of the different particles. However, when differently sized particles are mixed into a single solution, the overall long-term stability of these particles within that single solution may be substantially diminished as a result of unequal forces exerted on the various particles causing eventual agglomeration of the particles. This phenomenon may become even more pronounced when that solution is either heated or cooled significantly above or below standard room temperature conditions.

Examples of stabilizing agents include alcohols (e.g., ethanol, propanol, butanol, etc.), polyphenols, mono-glycerides, di-glycerides, or triglycerides, oils, other terpenes, amine compounds (e.g., mono-, di-, or tri-ethanol amine), liposomes, other emulsions, and other polymers.

In some embodiments, stabilizing agents are dissolved within a separate carrier in the micro- to milli-molar concentration range with the upper range limitation typically being constrained not by efficacy but by product cost.

These various stabilizing agents have the capacity to hold at least two differently sized and/or shaped nanoparticles in suspension and deliver these nanoparticles into the treatment area of a plant or plant part without so powerfully retaining the nanoparticles so as to diminish the antimicrobial properties of the nanoparticles.

Fuel Treatment Methods and Methods of Manufacture

In some embodiments, a method of treating a hydrocarbon fuel comprises: (1) obtaining a fuel additive composition as disclosed herein: and (2) adding the fuel additive composition to the hydrocarbon fuel. This may involve, for example, pouring, mixing, spray application, or dropping a solid form into a tank of fuel. In some embodiments, the fuel additive composition is added in an amount to yield a treated hydrocarbon fuel containing from about 10, 30, or 50 ppb to about 10 ppm, or about 100 ppb to about 5 ppm, or about 200 ppb to about 1 ppm, or about 300 ppb to about 800 ppb of metal nanoparticles by weight.

In the case of gasoline or diesel powered vehicles, an exemplary fuel additive composition can be provided as a liquid or gel which is added in an amount of about 10 ml to about 500 ml, or about 50 ml to about 250 ml, or about 75 ml to about 150 ml, for every 20 gallons (76 liters) of fuel. The fuel additive composition can be provided inside a standard fuel additive container, such as those having a generally enlarged lower tank portion and a narrow, elongated neck portion to facilitate insertion into the opening of a fuel tank.

Alternatively, the fuel additive composition may contain a solid carrier, wherein the fuel is treated by causing or allowing the hydrocarbon fuel to dissolve the solid carrier in order to release and disperse the metal nanoparticles.

In some embodiments, a method of manufacturing a fuel additive composition, comprising combining: (1) a plurality of metal nanoparticles selected from the group consisting of solid spherical-shaped metal nanoparticles and/or coral-shaped metal nanoparticles in which each coral-shaped metal nanoparticle has a non-uniform cross section and a globular structure formed by multiple, non-linear strands joined together without right angles; and (2) a carrier that is readily miscible in a hydrocarbon fuel. The carrier can have any desired physical form, such as a liquid, gel or solid.

EXAMPLES

Example 1

40 ppm of spherical-shaped gold nanoparticles having a mean particle size of about 4 nm, with at least 99% of the gold nanoparticles having a particle size within 10% or less of the mean particle size are placed in a carrier to form a fuel additive.

Example 2

A treated gasoline fuel contained 100 ppb of spherical-shaped gold (Au) nanoparticles 4-5 nm in diameter, which were delivered into the gasoline using a triglyceride (fractionated coconut oil) carrier. Treating the gasoline in this manner produced a 22% increase in fuel efficiency in a 700 hp Ford Mustang engine.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fuel additive composition comprising:

a carrier that is readily miscible in a hydrocarbon fuel; and a plurality of metal nanoparticles selected from the group consisting of:

spherical-shaped metal nanoparticles formed so as to be spherical with no external bond angles or edges, have solid metal cores, and have a mean diameter of about 35 nm or less in which at least 99% of the spherical-shaped metal nanoparticles have a diameter within 30% of the mean diameter; and coral-shaped metal nanoparticles formed so that each coral-shaped metal nanoparticle has a non-uniform cross section and a globular structure formed by multiple, non-linear strands joined together without right angles, wherein the coral-shaped metal nanoparticles have a mean length in a range from about 15 nm to about 100 nm and wherein at least 99% of the coral-shaped metal nanoparticles have a length within 30% of the mean length, wherein the fuel additive composition is in a pre-dosed quantity formulated so as to treat from about 10 gallons (38 liters) to about 30 gallons (114 liters) of hydrocarbon fuel and provide a concentration of the metal nanoparticles in the hydrocarbon fuel when mixed therein of about 10 ppb to about 1 ppm by weight.

2. A fuel additive composition as in claim 1, wherein the carrier is a liquid, gel or solid.

3. A fuel additive composition as in claim 1, wherein the carrier comprises at least one material selected from the group consisting of vegetable oils, triglycerides, petroleum distillates, naphtha, diesel, kerosene, waxes, plant oils, polymers, alcohols, ketones, esters, ethers, organic solvents, methanol, ethanol, isopropyl alcohol, glycols, polyols, and surfactants.

4. A fuel additive composition as in claim 1, wherein the carrier comprises a solid container that encloses the metal nanoparticles and is readily dissolvable in a hydrocarbon fuel.

5. A fuel additive composition as in claim 1, wherein the fuel additive composition contains about 10 ppm to about 100 ppm by weight of metal nanoparticles by weight.

6. A fuel additive composition as in claim 1, wherein the metal nanoparticles comprise spherical-shaped nanoparticles having a mean diameter of about 10 nm or less.

7. A fuel additive composition as in claim 6, wherein at least 99% of the spherical-shaped nanoparticles have a diameter within ±3 nm of the mean diameter.

8. A fuel additive composition as in claim 6, wherein at least 99% of the spherical-shaped nanoparticles have a diameter within ±2 nm of the mean diameter.

9. A fuel additive composition as in claim 6, wherein the spherical-shaped nanoparticles have a $\xi$-potential of at least 10 mV.

10. A fuel additive composition as in claim 1, wherein the metal nanoparticles comprise at least one metal selected from the group consisting of gold, platinum, silver, palladium, rhodium, osmium, ruthenium, rhodium, rhenium, molybdenum, copper, iron, nickel, tin, beryllium, cobalt, antimony, chromium, manganese, zirconium, tin, zinc, tungsten, titanium, vanadium, lanthanum, cerium, heterogeneous mixtures thereof, and alloys thereof.

11. A method of treating a hydrocarbon fuel comprising adding the fuel additive composition of claim 1 to the hydrocarbon fuel to yield a treated hydrocarbon fuel containing about 10 ppb to about 1 ppm by weight of the metal nanoparticles.

12. A method as in claim 11, the treated hydrocarbon fuel containing from about 10 ppb to about 300 ppb of the metal nanoparticles by weight.

13. A method as in claim 11, wherein the fuel additive composition is a liquid or gel and wherein the pre-dosed quantity added to the hydrocarbon fuel is in a range of about 10 ml to about 500 ml.

14. A method as in claim 11, wherein the fuel additive composition contains a solid carrier, the method comprising causing or allowing the hydrocarbon fuel to dissolve the solid carrier in order to release and disperse the metal nanoparticles.

15. A method of treating a hydrocarbon fuel with a fuel additive composition, comprising:

adding a quantity of metal nanoparticles to the hydrocarbon fuel to yield a treated hydrocarbon fuel containing about 10 ppb to about 1 ppm by weight of the metal nanoparticles, wherein the metal nanoparticles are selected from the group consisting of:

spherical-shaped metal nanoparticles formed so as to be spherical with no external bond angles or edges, have solid metal cores, and have a mean diameter of about 35 nm or less in which at least 99% of the spherical-shaped metal nanoparticles have a diameter within 30% of the mean diameter; and coral-shaped metal nanoparticles formed so that each coral-shaped metal nanoparticle has a non-uniform cross section and a globular structure formed by multiple, non-linear strands joined together without right angles, wherein the coral-shaped metal nanoparticles have a mean length in a range from about 15 nm to about 100 nm and wherein at least 99% of the coral-shaped metal nanoparticles have a length within 30% of the mean length.

16. A method as in claim 15, wherein the metal nanoparticles are provided in a fuel treatment composition comprising the metal nanoparticles and a carrier.

17. A method as in claim 16, wherein the carrier comprises at least one material selected from the group consisting of vegetable oils, triglycerides, petroleum distillates, naphtha, diesel, kerosene, waxes, plant oils, polymers, alcohols, ketones, esters, ethers, organic solvents, methanol, ethanol, isopropyl alcohol, glycols, polyols, and surfactants.

18. A method as in claim 15, wherein the metal nanoparticles comprise at least one metal selected from the group consisting of gold, platinum, silver, palladium, rhodium, osmium, ruthenium, rhodium, rhenium, molybdenum, copper, iron, nickel, tin, beryllium, cobalt, antimony, chromium, manganese, zirconium, tin, zinc, tungsten, titanium, vanadium, lanthanum, cerium, heterogeneous mixtures thereof, and alloys thereof.

19. A method as in claim 15, wherein the treated hydrocarbon fuel contains from about 10 ppb to about 300 ppb by weight of the metal nanoparticles.

20. A method of treating a hydrocarbon fuel to improve combustion, comprising:

providing a fuel additive composition comprising a carrier that is readily miscible in the hydrocarbon fuel and a plurality of spherical-shaped metal nanoparticles having a mean diameter of about 10 nm or less and in which at least 99% of the spherical-shaped metal nanoparticles have a diameter within 30% of the mean diameter, the spherical-shaped metal nanoparticles comprising at least one metal selected from the group consisting of gold, platinum, silver, palladium, rhodium, osmium, ruthenium, rhodium, rhenium, molybdenum, copper, iron, nickel, tin, beryllium, cobalt, antimony, chromium, manganese, zirconium, tin, zinc, tungsten, titanium, vanadium, lanthanum, cerium, heterogeneous mixtures thereof, and alloys thereof; and adding the fuel additive composition to the hydrocarbon fuel to yield a treated hydrocarbon fuel containing about 10 ppb to about 1 ppm by weight of the spherical-shaped metal nanoparticles.

* * * * *